US009980560B2

(12) United States Patent
Christian et al.

(10) Patent No.: US 9,980,560 B2
(45) **Date of Patent: *May 29, 2018**

(54) TABLE LEVELER THAT LEVELS A TABLETOP

(71) Applicants: Steven Christian, Houston, TX (US); Ronald G Presswood, Houston, TX (US)

(72) Inventors: Steven Christian, Houston, TX (US); Ronald G Presswood, Houston, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/464,323

(22) Filed: Mar. 20, 2017

(65) Prior Publication Data

US 2017/0188699 A1 Jul. 6, 2017

Related U.S. Application Data

(63) Continuation-in-part of application No. 15/081,881, filed on Mar. 26, 2016, now Pat. No. 9,713,376.

(60) Provisional application No. 62/140,150, filed on Mar. 30, 2015.

(51) Int. Cl.

| | |
|---|---|
| ***A47B 13/00*** | (2006.01) |
| ***A47B 13/08*** | (2006.01) |
| ***A47B 13/02*** | (2006.01) |

(52) U.S. Cl.

CPC ..... *A47B 13/003* (2013.01); *A47B 13/023* (2013.01); *A47B 13/081* (2013.01)

(58) Field of Classification Search

CPC .... A47B 2200/0043; A47B 2200/0044; A47G 33/1226; F16M 11/10; F16M 11/12; F16M 11/121; F16M 11/125

USPC ..... 108/1, 4; 248/514, 515, 516, 133, 139, 248/140, 143, 371

See application file for complete search history.

(56) References Cited

U.S. PATENT DOCUMENTS

| | | | | |
|---|---|---|---|---|
| 2,893,674 A * | 7/1959 | Monaco | A47B 11/00 | 248/183.2 |
| 3,026,159 A * | 3/1962 | Miller | B25H 3/06 | 108/1 |
| 3,974,994 A * | 8/1976 | Petterson | F16F 15/02 | 248/663 |
| 4,415,136 A * | 11/1983 | Knoll | F16M 11/14 | 248/181.2 |
| 4,645,153 A * | 2/1987 | Granzow | F16M 11/126 | 248/181.2 |
| 5,277,392 A * | 1/1994 | Rossman | F16M 11/126 | 248/231.71 |
| 5,398,901 A * | 3/1995 | Brodmann | A47B 81/06 | 248/181.1 |
| 5,690,303 A * | 11/1997 | Winters | A47B 91/00 | 248/188.3 |
| 7,930,980 B2 * | 4/2011 | Brooke | A47B 13/023 | 108/153.1 |
| 8,356,779 B2 * | 1/2013 | Stengel | A47B 81/061 | 248/125.1 |

(Continued)

*Primary Examiner* — Jose V Chen

(57) ABSTRACT

A table leveler fastens underneath a top of a table and adjusts a level of the top of the table. The table leveler attaches between the top of the table and a riser and includes a body with a plurality of legs that extend outwardly and attach to an underside of the top of the table. An arm pivots about the body and moves the table leveler between a locked position and an unlocked position.

19 Claims, 11 Drawing Sheets

(56) References Cited

U.S. PATENT DOCUMENTS

| | | | | |
|---|---|---|---|---|
| 8,640,998 | B2 * | 2/2014 | Lau | F16M 11/041 248/121 |
| 9,713,376 | B2 * | 7/2017 | Christian | A47B 13/081 |
| 2003/0230681 | A1 * | 12/2003 | Gwynneth | A47B 91/16 248/188.3 |
| 2006/0000958 | A1 * | 1/2006 | Li | F16M 11/18 248/188.3 |
| 2009/0236479 | A1 * | 9/2009 | Rose | A47B 97/00 248/188.7 |
| 2012/0085873 | A1 * | 4/2012 | Brooke | A47B 91/16 248/188.3 |
| 2016/0029784 | A1 * | 2/2016 | Pike | A47B 91/16 248/188.2 |

* cited by examiner

TABLE LEVELER THAT LEVELS A TABLETOP

BACKGROUND

Tables in bars and restaurants are often moved to accommodate customer seating. After moving a table, the top of the table may no longer be level since the floor on which the table rests may not be level. If the top of the table is not level, then it can cause an inconvenience or annoyance to customers sitting at the table.

Tables can also be moved to abut against each other and create a larger seating and serving area for customers. Often, ends of abutting tables, however, do not align since a top of one table is higher than a top of the other table. This situation creates a ledge or drop-off where food and other things can fall over, break, or spill, which can also cause an inconvenience or annoyance to customers sitting at the table.

SUMMARY OF THE INVENTION

One example embodiment is a table leveler that fastens underneath a top of a table and adjusts a level of the table. The table leveler includes a lever and a body with a plurality of legs that extend outwardly from the body. The lever moves between a locked position in which the table leveler locks the top of the table to a riser and an unlocked position in which the table leveler unlocks the top of the table from the riser. In the unlocked position, the level or tilt of the top of the table can be adjusted.

Other example embodiments are discussed herein.

DETAILED DESCRIPTION

Example embodiments relate to methods and apparatus that use a table leveler to move and level a top of a table.

As noted in the Background section, the top of a table may no longer be level after it is moved or after it is placed on the floor since the floor itself may not be level. Additionally, ends of abutting tables may not align since a top of one table is higher than or lopsided with a top of the other table. Example embodiments solve these problems and other problems associated with leveling a top of a table.

One example embodiment is a table leveler that fastens underneath a top of a table and connects to a top of a riser or support that connects to a base of the table. The table leveler includes a square or circular body with a lever or arm and a plurality of legs that extend outwardly from the body. The lever moves between a locked position in which the table leveler locks the top of the table to the riser and an unlocked position in which the table leveler unlocks the top of the table from the riser. In the unlocked position, the level or tilt of the top of the table can be adjusted.

By way of example, the body of the table leveler includes one of a convex or concave shape that rests in or engages with a complimentary convex or concave shape at an end of the riser. As such, the table leveler can move or float when it is in the unlocked position. For instance, the table leveler engages the riser in a ball and socket configuration. In the unlocked position, the ball and socket are moveable to adjust a tilt or level of the top of the table (also known as a tabletop).

People can use the table leveler to adjust a level or angle of tilt of the top of the table without using any tools, such as a screwdriver, wrench, hammer, or other tool. Further, people can adjust the level of the top of the table without kneeling or lying on the floor, without being required to look under the top of the table, or without bending down. The level of the table can be readily adjusted while standing or sitting next to the table by moving an arm or lever of the table leveler that is positioned under the top of the table and near the riser.

With example embodiments, people (such as customers or staff in a bar or restaurant) can easily move a top of a table and adjust its levelness. Example embodiments thus provide people with a quick, convenient, and easy way to adjust or change a level of a top of a table.

Figure 1:
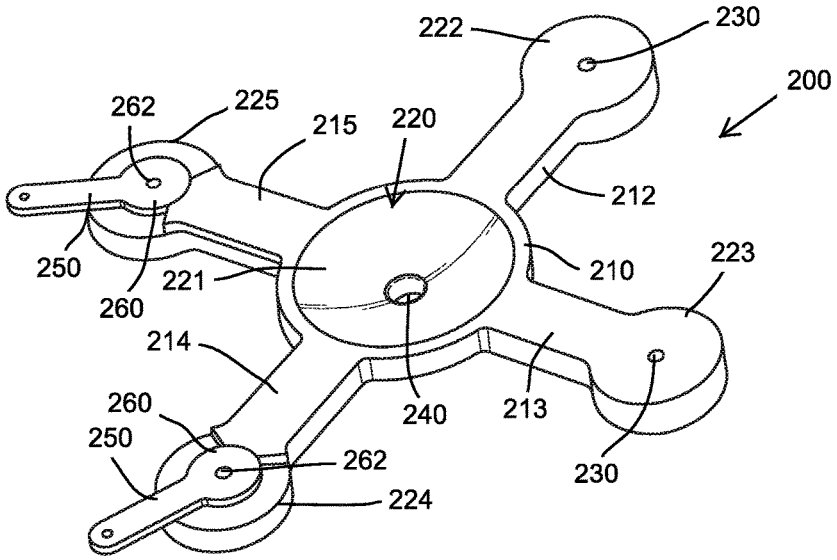
FIG. 1 shows a table leveler in accordance with an example embodiment.
Figure 4:
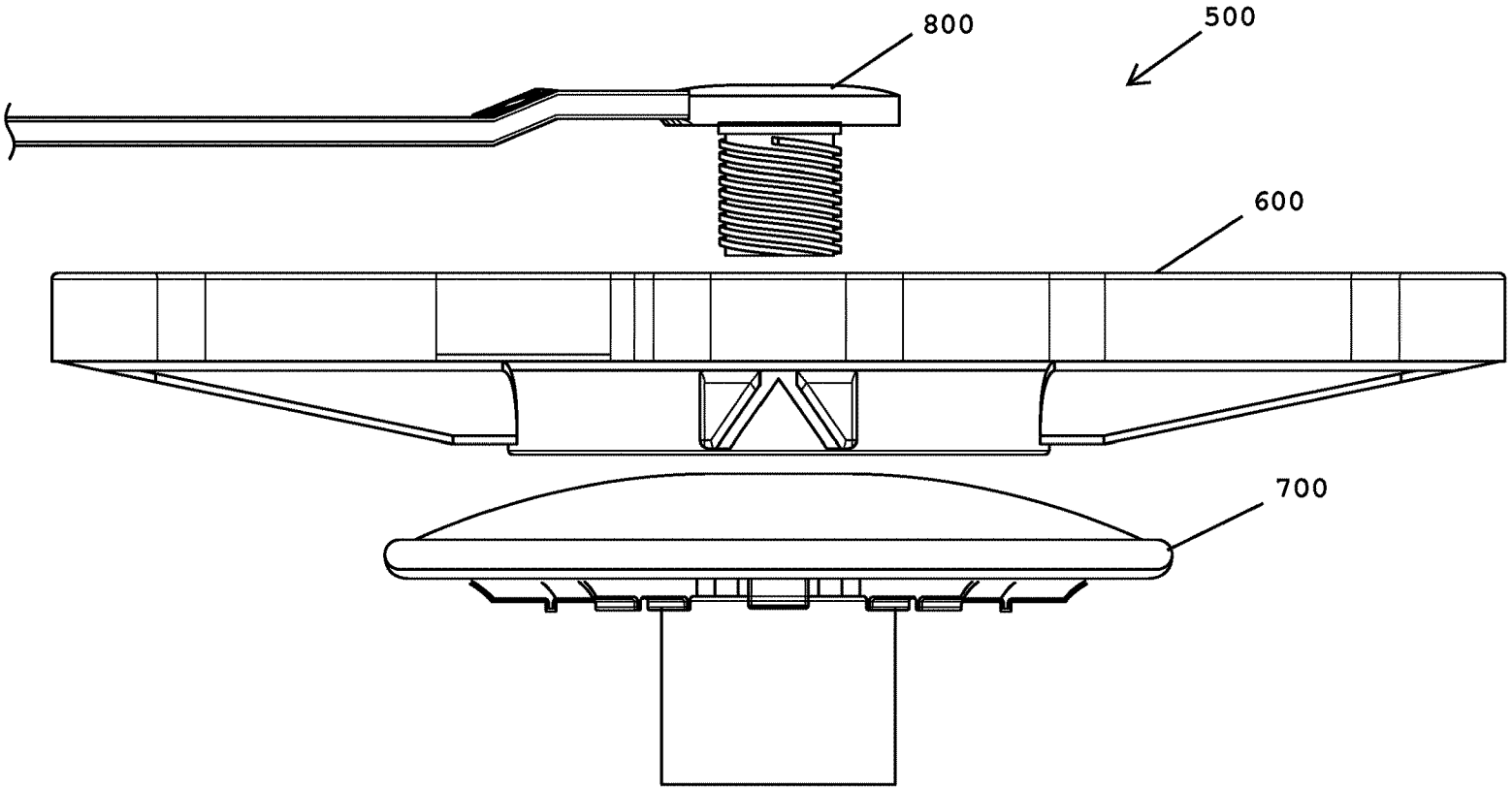
FIG. 4 shows a side view of a disassembled table leveler having three components in accordance with an example embodiment.

FIG. 1 shows table leveler 200 in accordance with an example embodiment. Table leveler 200 includes a body 210 with four legs 212, 213, 214, and 215 extending outwardly from and integrally formed with the body 210. The body has a round or dome shape that forms a partial spherical or concave cavity 220 with a smooth inner surface 221. The legs have an elongated rectangular shape with a rounded or bone-shaped end 222, 223, 224, and 225. Ends of one or more of the legs include an opening 230 to receive a screw, rivet, nail, or other fastener to attach the table leveler to an underside of a top of a table. The body 210 includes a hole 240 that receives and connects to a riser or support of the table (shown in FIG. 4). The flat side of the legs seats against the underside of the top of the table.

Two of legs 214 and 215 include a lever or arm 250 that adjusts a tilt or angle of the top of the table. The lever 250 has an elongated shape with a round end 260 with a hole and fastener 262 that connects to an end of the leg. The lever is movable or rotatable to adjust the tilt or angle of the table.

Figure 2:
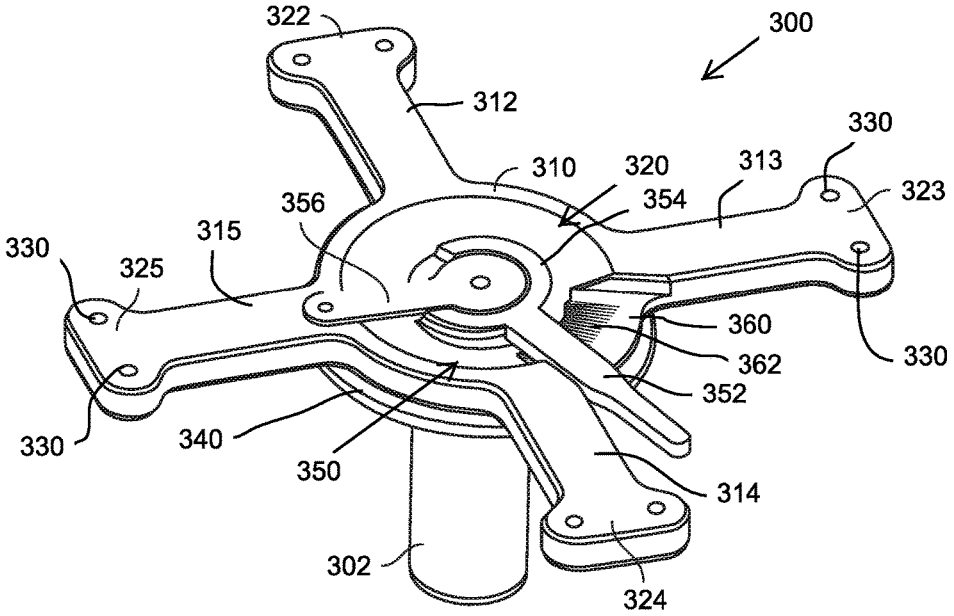
FIG. 2 shows a table leveler attached to a riser of a table in accordance with an example embodiment.

FIG. 2 shows a table leveler 300 attached to a riser 302 of a table in accordance with an example embodiment. Table leveler 300 includes a body 310 with four legs 312, 313, 314, and 315 extending outwardly from and integrally formed with the body 310. The body has a round or dome shape that forms a partial spherical or concave cavity 320 on one side and a corresponding convex cavity on the other side. The legs have an elongated rectangular shape with a rounded or bone-shaped end 322, 323, 324, and 325 and a flat side that seats against or engages the underside of the top of the table. Ends of the legs include two openings 330 to receive a screw, rivet, nail, or other fastener to attach the table leveler to the underside of a top of a table.

The riser 302 (also known as a support) connects a base of the table to the top of the table or tabletop. The riser has a convex shaped end 340 that matches or fits within a concave shaped cavity 320 of the body 310 such that table leveler moves with respect to the riser in order to adjust a tilt or angle of the top of the table. For example, the table leveler (and table top to which the table leveler is attached) moves with a ball-and-socket configuration with the end of the riser.

The table leveler 300 includes a locking mechanism 350 that locks and unlocks the table leveler to the end of the riser in order to lock and unlock the table leveler from the riser and hence adjust the top of the table. The locking mechanism includes an arm or lever 352 with a C-shaped end 354 that rotates about a cylindrical end of a second arm or stop 356. A ramped, curved, or inclined surface 360 includes a plurality of ridges or indentations 362 into which the lever 352 engages.

The lever 352 is movable between an unlocked position (shown in FIG. 2) and a locked position. In the unlocked position, the lever 352 seats against or abuts a side of leg 314. In the locked position, the lever 352 seats against or abuts a side of leg 313. When the lever is in the unlocked position, the table leveler disengages or unlocks from the riser such that the table leveler can move (e.g., similar to movements of a ball-and-socket). When the lever is in the locked position, the table leveler clamps against or forcibly engages or presses against the riser such that the table leveler cannot move with respect to the riser. The ridges 362 assist in maintaining the lever 352 in a position between the locked and unlocked positions.

FIGS. 3A-3D show a table leveler 400 attached to a riser 402 in accordance with an example embodiment. Table leveler 400 includes a body 410 with four legs 412, 413, 414, and 415 extending outwardly from and integrally formed with the body 410. The body has a round or dome shape that forms a partial spherical or convex cavity 420. The legs have an elongated rectangular shape with a rounded or bone-shaped end 422, 423, 424, and 425 and a flat side that seats against or engages the underside of the top of the table. Ends of the legs include two openings 430 to receive a screw, rivet, nail, or other fastener to attach the table leveler to the underside of a top of a table.

An elongated lever 440 includes a rounded end with a hole 442 through which a fastener or rod 444 pivotally connects the lever to the body 410. The body 410 also includes a channel 450 to enable the lever to move between an unlocked position (shown in FIGS. 3A-3D) and a locked position.

The riser 402 includes a column 460 with a cup-shaped, bowl-shaped, or partial spherical end with a concave surface 462 that interfaces or engages with the convex surface 464 of the body 410 of the table leveler.

A locking mechanism 470 enables the table leveler to move between a locked and unlocked position. In the locked position, the table leveler locks against the riser and cannot be moved or adjusted. In the unlocked position, the table leveler unlocks against the riser and can be moved or adjusted to change a level, tilt, or angle of the top of the table.

Figure 3A:
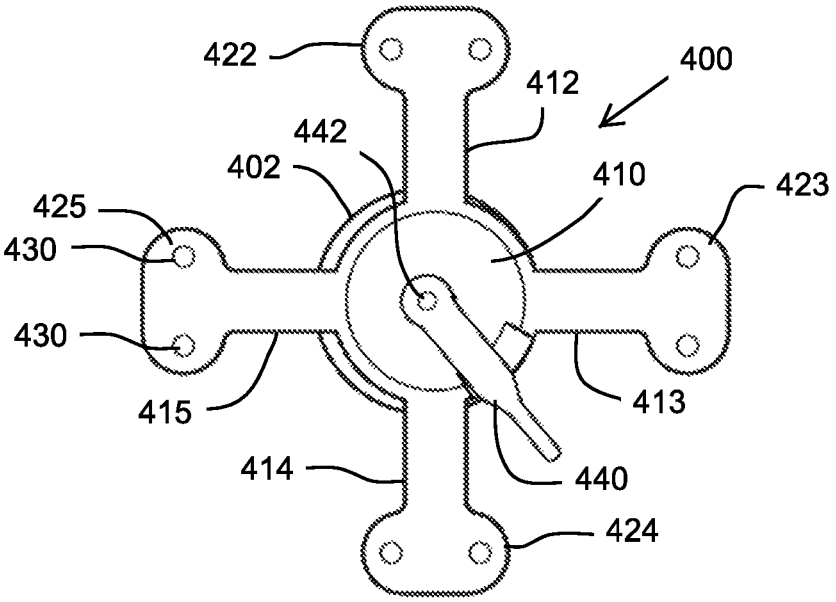
FIG. 3A shows a top view of a table leveler attached to a riser in accordance with an example embodiment.
Figure 3B:
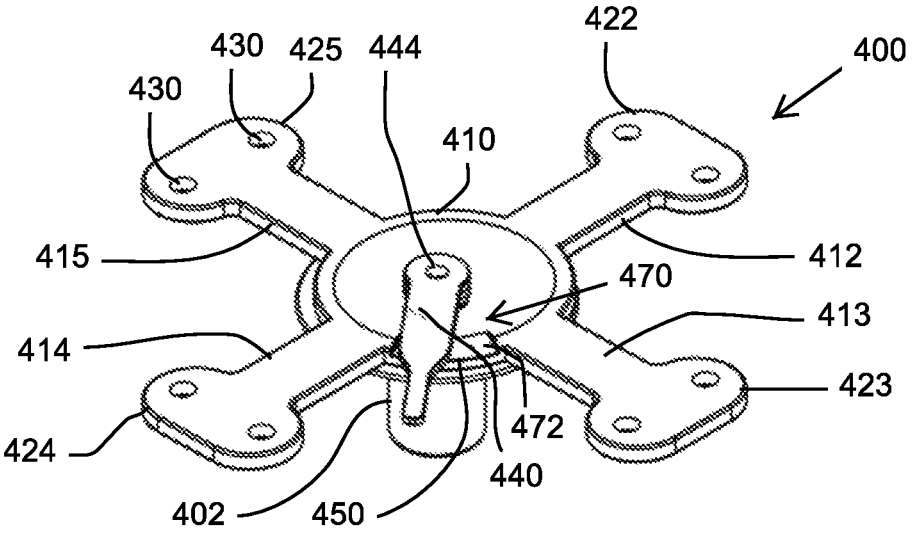
FIG. 3B shows a perspective view of the table leveler attached to the riser in accordance with an example embodiment.
Figure 3C:
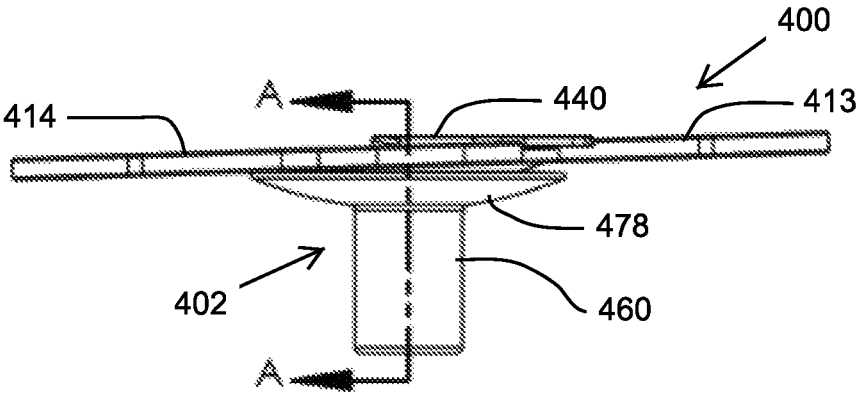
FIG. 3C shows a side view of the table leveler attached to the riser in accordance with an example embodiment.
Figure 3D:
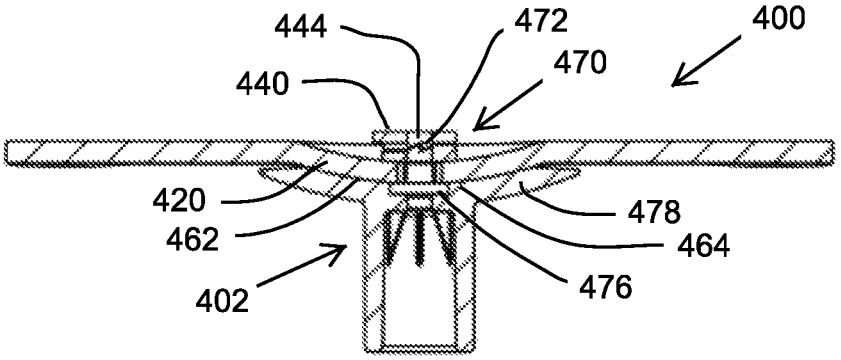
FIG. 3D shows a cross-sectional view taken along line A-A of FIG. 3C of the table leveler attached to the riser in accordance with an example embodiment.

As best shown in FIG. 3D, the locking mechanism 470 includes a ridge or ledge 472 into which the lever 440 moves between the locked and unlocked positions. In the locked position, a washer, nut, or other device 476 forcibly seats against a wall 478 of the riser. In the unlocked position, this device 476 unseats or loosens so the riser and table leveler can be moved with respect to each other as the lever 440 rotates about pin 444.

FIGS. 4-9 show various views of a table leveler 500 that includes three different and separate components or bodies (a body or component 600, a body or component 700, and a body or component 800). These three components can be separated or disassembled (e.g., shown in FIG. 4) or assembled together (e.g., shown in FIGS. 5A, 5B, 6A, and 6B).

In one example embodiment, the table leveler 500 is manufactured as three separate components 600, 700, and 800 that fit together to form the table leveler. Manufacturing the table leveler 500 as three separate components facilitates manufacturing and assembly and also reduces manufacturing costs. Further, the table leveler 500 can be disassembled into the three components so that individual components can be replaced or repaired if damaged. Furthermore, components from one table leveler can be swapped or used with another table leveler of comparable size.

Figure 6A:
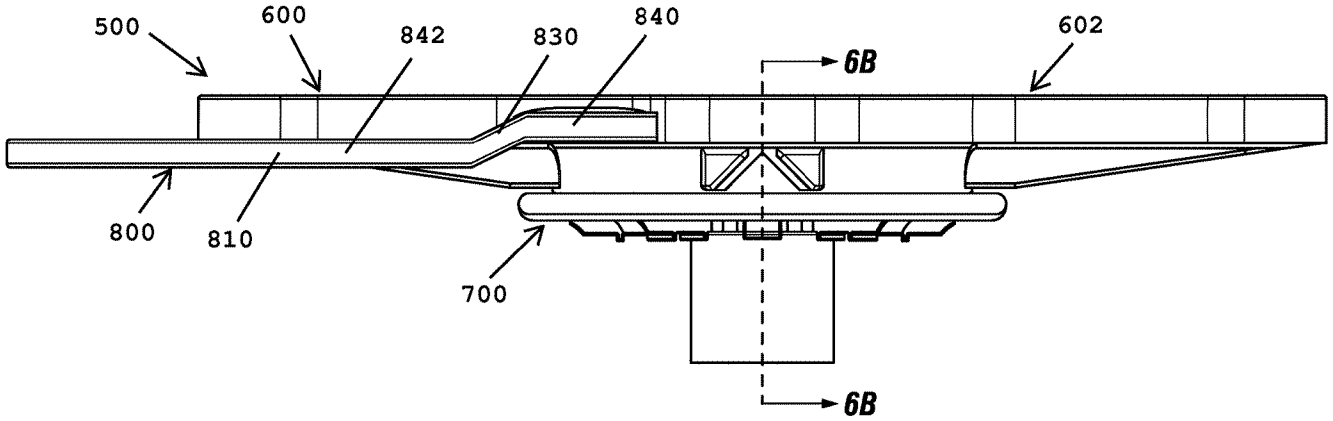
FIG. 6A shows a side view of a table leveler in accordance with an example embodiment.
Figure 6B:
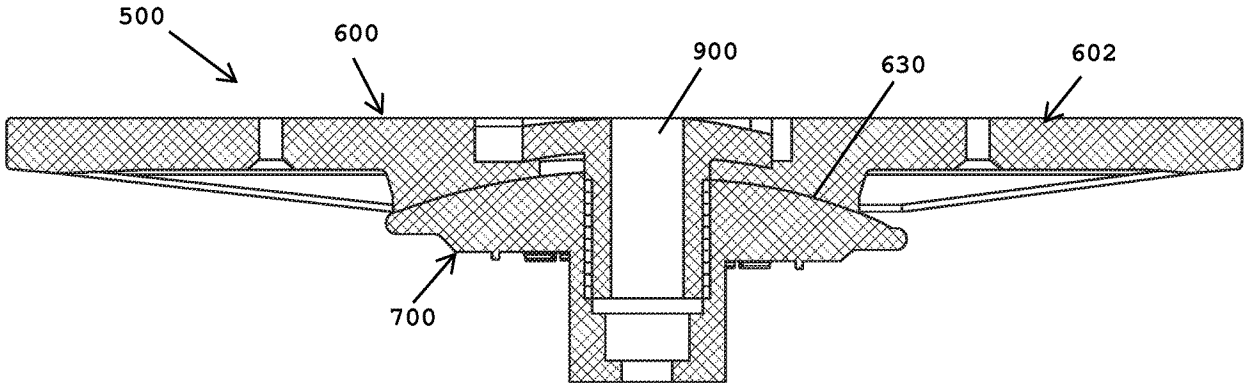
FIG. 6B shows a cross-sectional view of the table leveler taken along lines 6B-6B in FIG. 6A in accordance with an example embodiment.

The component 600 includes flat or planar side 602 that seats against and engages a flat or planar side or underside of a table top (e.g., see FIGS. 6A and 6B showing the flat side 602). The component includes a body 610 with a plurality of legs or extensions that extend outwardly from the body. By way of illustration, four legs 612, 613, 614, and 615 extend outwardly from and are integrally formed with the body 610. Instead of four legs, an example embodiment can include two legs, three legs, five legs, or more. The legs are equally spaced apart from each other around an outer edge or perimeter of the body 610 and have an elongated shape. As shown with leg 612 (FIG. 7A), this shape includes a rectangular body 620 with a rounded end or bone-shaped end 622. Each leg also includes one or more holes 624 that receive a fastener (such as a screw or nail) to fasten the body 600 to an underside of a tabletop.

The body 610 has a round or dome shape that forms a partial spherical or concave cavity 630 on one side and a corresponding convex cavity on the other side. A hole 640 extends through a center of the body 610.

Figure 5A:
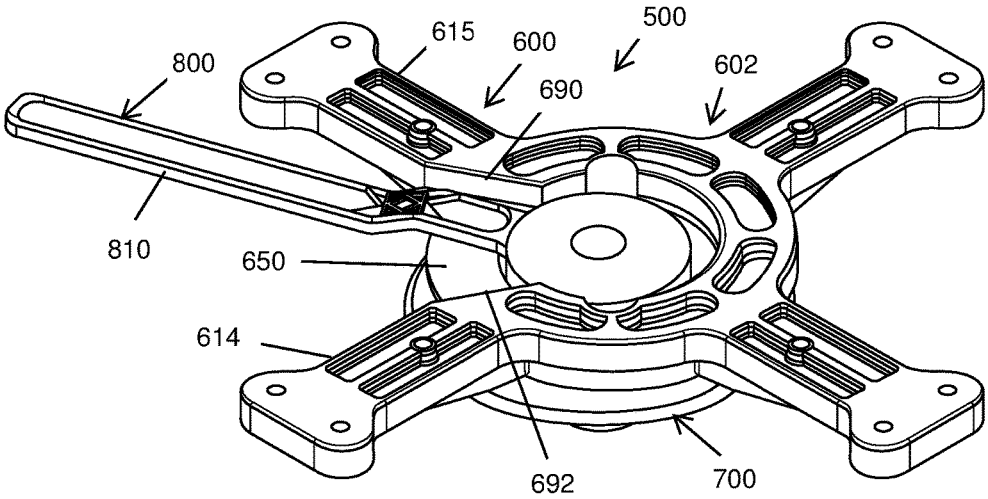
FIG. 5A shows a bottom perspective view of a table leveler in accordance with an example embodiment.
Figure 5B:
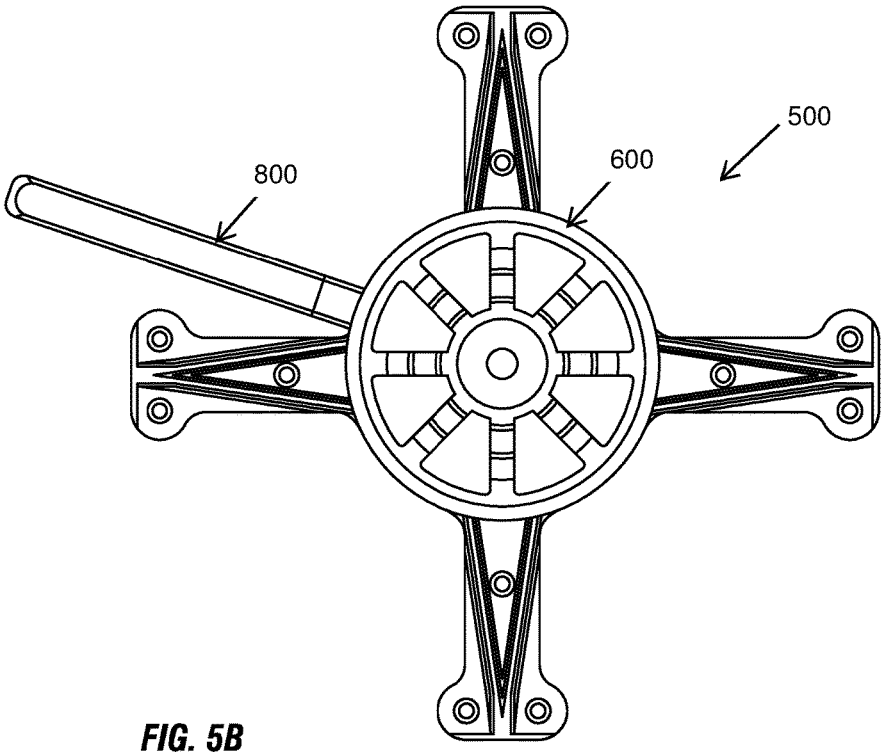
FIG. 5B shows a top view of the table leveler of FIG. 5A in accordance with an example embodiment.
Figure 7A:
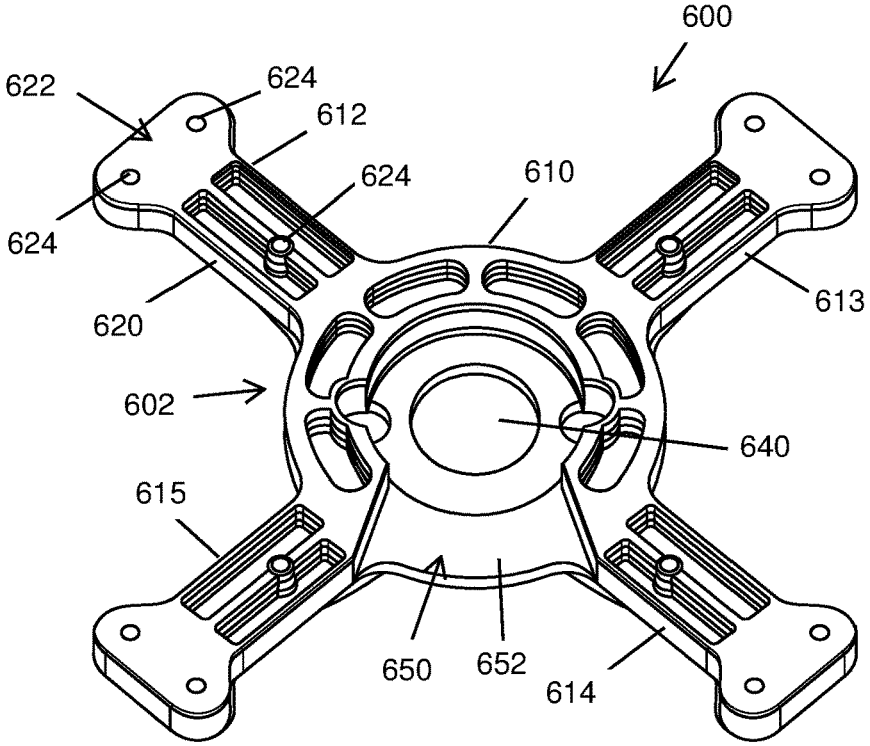
FIG. 7A shows a top perspective view of a first component of a table leveler in accordance with an example embodiment.
Figure 7B:
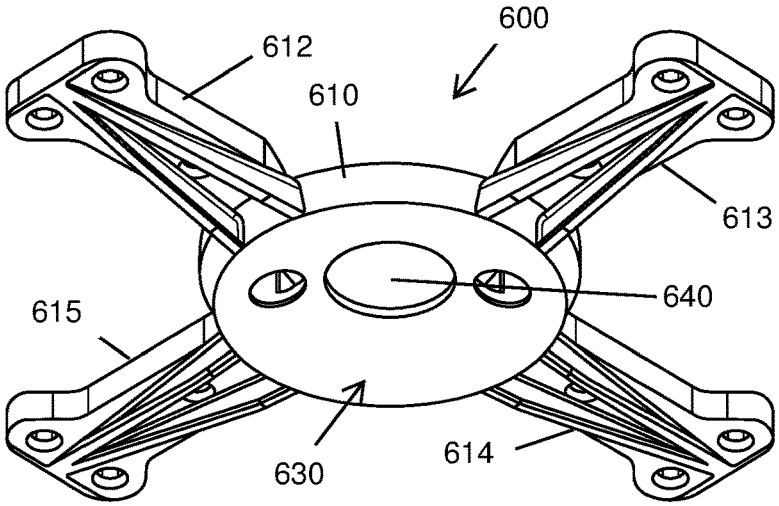
FIG. 7B shows a bottom perspective view of the first component of the table leveler shown in FIG. 7A in accordance with an example embodiment.
Figure 8A:
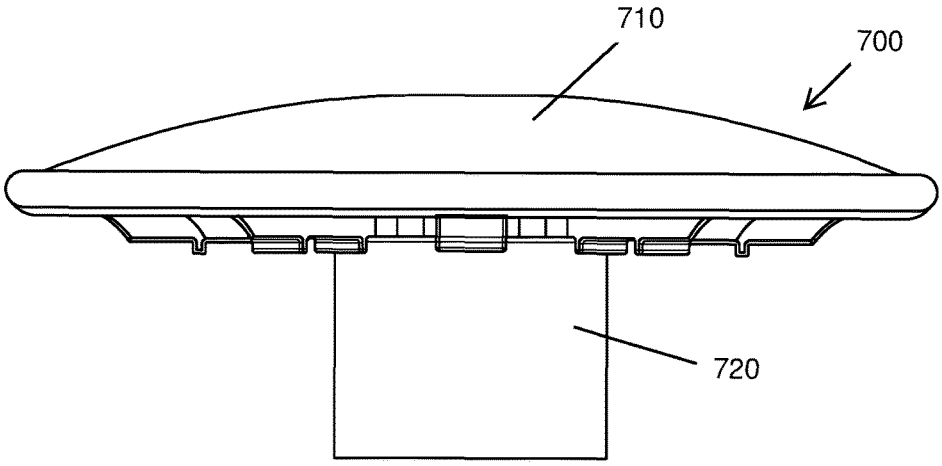
FIG. 8A shows a side view of a second component of a table leveler in accordance with an example embodiment.
Figure 8B:
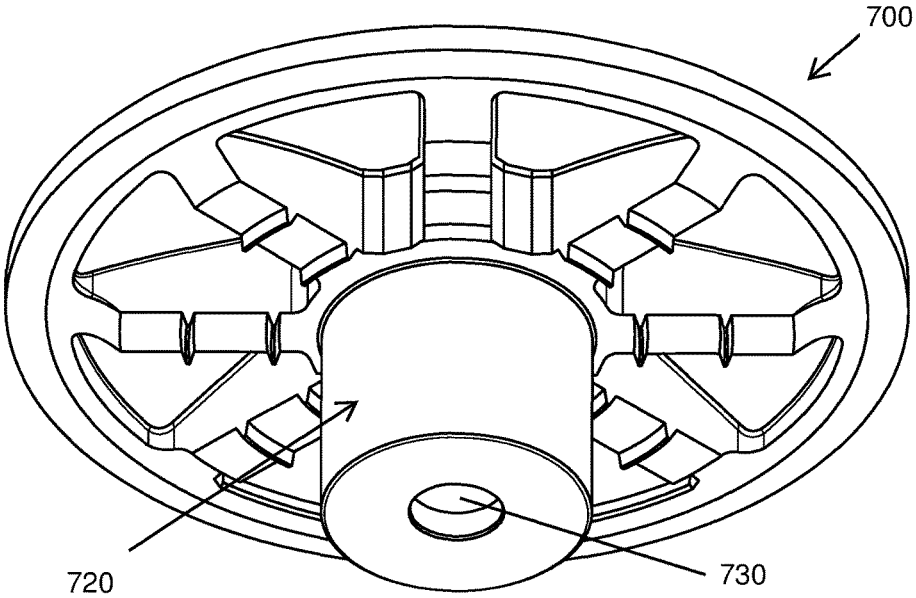
FIG. 8B shows a bottom perspective view of the second component of the table leveler shown in FIG. 8A in accordance with an example embodiment.
Figure 8C:
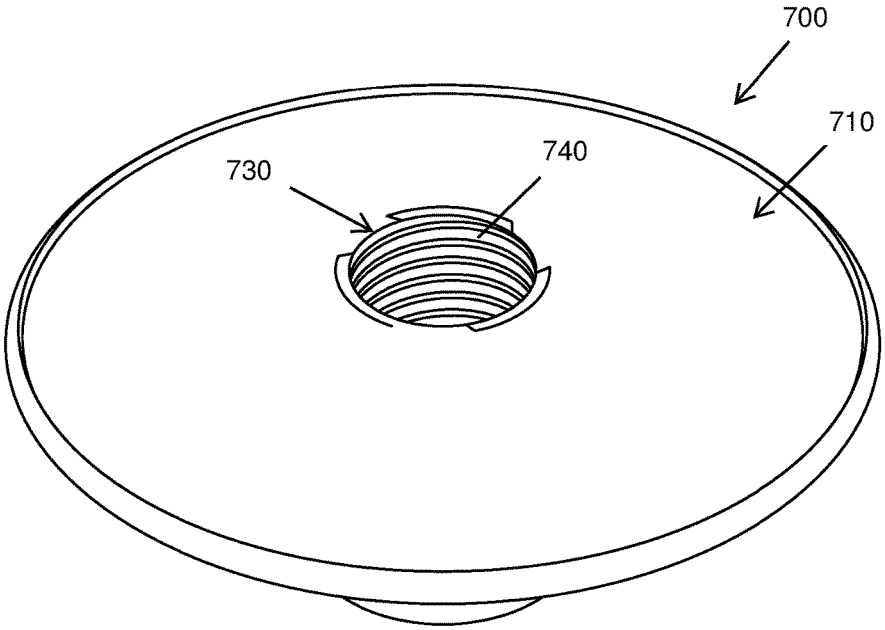
FIG. 8C shows a top perspective view of the second component of the table leveler shown in FIG. 8A in accordance with an example embodiment.
Figure 9A:
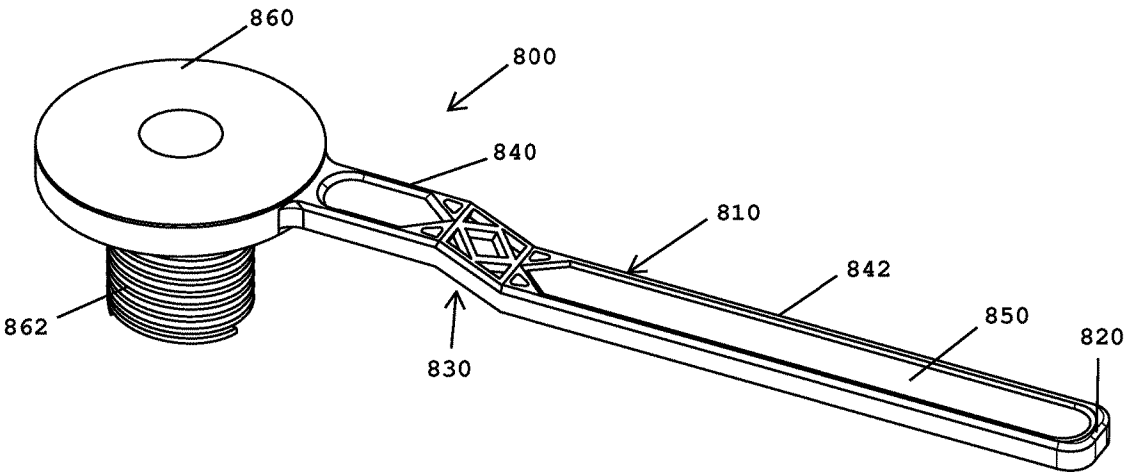
FIG. 9A shows a top perspective view of a third component of a table leveler in accordance with an example embodiment.
Figure 9B:
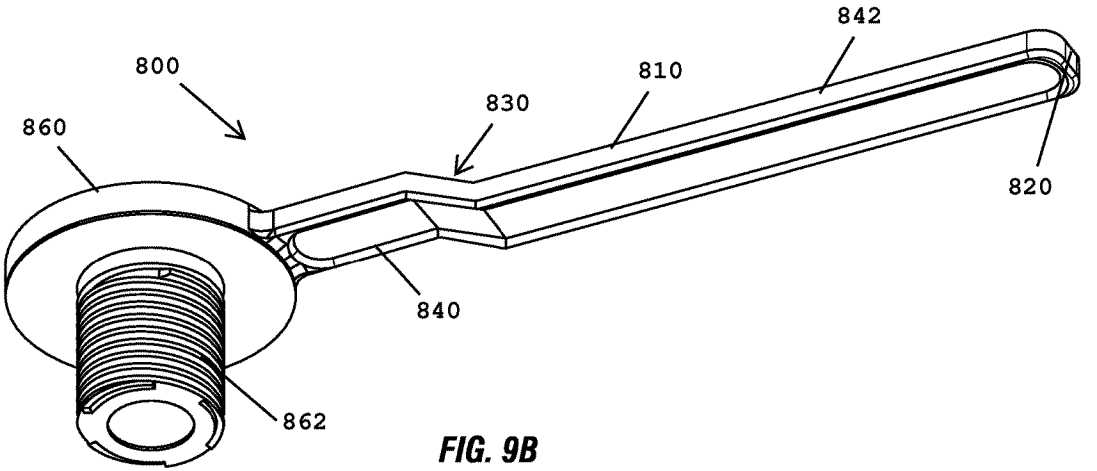
FIG. 9B shows a bottom perspective view of the third component of the table leveler shown in FIG. 9A in accordance with an example embodiment.

As best shown in FIGS. 5A and 7A, the flat side 602 of body 610 includes a recess or channel 650 that receives component 800. This channel has an arc shape that partially extends around a perimeter of the body 610. This channel does not extend through the body 610, but includes a flat smooth surface 652 (FIG. 7A) on which the component 800 engages and slides to move the table leveler between a locked position and an unlocked position.

The component 700 (also known as a support or a riser) connects a base of the table to the top of the table or tabletop. The component 700 has a mushroom shape in side view (FIG. 8A) and includes a rounded convex shaped end or dome-shaped head 710 that matches or fits within the concave shaped cavity 630 of component 600 such that the table leveler moves with respect to the riser in order to adjust a tilt or angle of the top of the table. For example, the table leveler (and table top to which the table leveler is attached) moves with a ball-and-socket configuration of the concave and convex shapes of the first and second components. In this manner, an outer surface of the convex shaped end 710 fits into, engages with, and rotates in a surface of the concave shaped cavity 630 in order to change a level of the tabletop.

The component 700 also includes an extension 720 with a cylindrical shape that extends outwardly from an underside of the convex shaped end 710. A bore or hole 730 extends through a center of the component 700 and through both the convex shaped end 710 and extension 720. This hole 730 includes threads 740 that engage threads on an end of component 800.

The extension 720 can have a straight shape or a taper shaped as seen in a side view and is configured to receive or be received in a riser or support of the table (e.g., an elongated cylindrical extension of the table that extends between the tabletop and the feet). In this way, the table leveler can connect to the table.

The component 800 is shaped as a lever or tool that enables a user to engage and disengage the component 600 from component 700. Component 800 includes an elongated handle 810 with a rectangular shape that has a rounded end. This handle is sized and shaped to be gripped or grabbed by the hand of a user. As seen in a side view or perspective view (FIGS. 6A, 9A, and 9B), the handle 810 includes a step or angled portion that exists between a first straight portion 840 and a second straight portion 842. This step follows the contour or shape of the channel 650 in component 600.

An opposite end of component 800 includes a short cylindrically shaped head 860 with an elongated threaded cylindrically shaped extension 862 extending outwardly from one side of the head 860. The threaded extension 862 extends at a right angle with respect to the handle 810 (see FIGS. 4 and 9B).

The extension 862 is threaded to enable it to threadably engage threads 740 in hole 730 of component 700. In this manner, the table leveler 500 includes a locking mechanism in the form of engagement of the threaded extension 862 of component 800 to threaded hole 730 of component 700. This locking mechanism locks and unlocks component 600 to and from component 700 and enables a user to adjust a level of the tabletop since component 600 can move or float within component 700 in the unlocked position. When threads 740 are engaged in hole 730 and component 800 is rotated to a tightened position, components 600 and 700 are forced against each other such that the friction between concave shaped cavity 630 and convex shaped end 710 prevent these components from moving with respect to each other and thus prevent the tabletop from moving. For example, the threads of the threaded extension 862 of the component 800 engage the threads 740 in hole 730 of component 700 and enable component 800 to move between a locked position in which the convex shaped end 710 of component 700 frictionally locks against the concave cavity 630 of component 600 and an unlocked position in which the convex shaped end 710 of component 700 frictionally locks against the concave cavity 630 of component 600 so component 600 can move with respect to component 700 and adjust a level of the tabletop of the table.

As best shown in FIG. 5A, component 800 can be rotated between a locked position (shown in FIG. 5A) when handle 810 abuts against sidewall 690 of leg 615 and an unlocked position when handle 810 abuts against sidewall 692 of leg 614. Movement of handle 810 along the surface of channel 650 enables the locking mechanism to engage and disengage the table leveler to the table.

As best shown in FIGS. 5A, 5B, 7A, 7B, and 8C, the component 700 has a circular shape from a top view with a size that matches or approximates a size of the circular body 610 of component 600. From a top view, the circular body 610 and the dome-shaped head 710 have a radius with a same length or approximately the same length (e.g., lengths within ten percent (10%) of each other).

FIG. 6B shows a centrally located hole 900 extends through the table leveler 500 and each of component 600, component 700, and component 800. Holes in each of these respect components centrally align to form hole 900.

FIGS. 6A and 6B show that the table leveler 500 has a T-shape in a side view when components 600, 700, and 800 are assembled together to form the table leveler.

Figure 10:
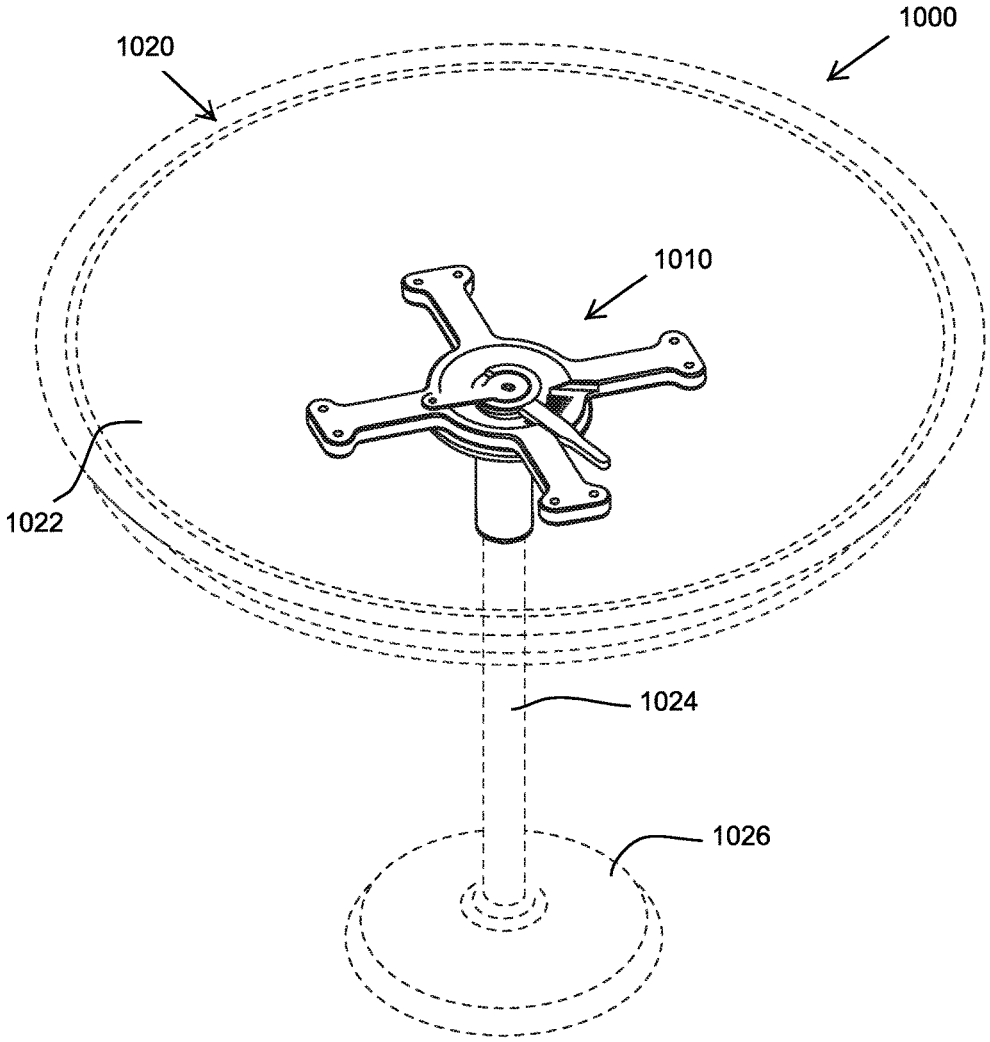
FIG. 10 shows a table assembly that includes a table leveler attached to a table in accordance with an example embodiment.

FIG. 10 shows a table assembly 1000 that includes a table leveler 1010 (such as a table leveler in accordance with an example embodiment) and a table 1020 (shown in dashed lines).

The table includes a tabletop 1022, a riser or support 1024, and a base 1026. The riser extends between and attaches to the tabletop and the base that sits on the floor. By way of illustration, the table leveler 1010 is similar to the table leveler 300 shown in FIG. 2; though the table leveler includes other embodiments discussed herein. The table leveler attaches to an underside of the tabletop and enables a user to adjust a level of the tabletop.

The table leveler can have different shapes, such as a spider-shape, star-shape, or other shape with a body and three or more legs extending outwardly therefrom. Further, the legs can be equally spaced around the body and have different shapes, such as elongated rectangular, cylindrical, square, rounded, or another shape.

One example embodiment is a method that uses a table leveler to adjust a tilt or position of a tabletop of a table. The table is provided with a base, the tabletop, and a column or riser that extends between the base and the tabletop. The tabletop can have various shapes and sizes (such as square, rectangular, circular, etc.).

The table leveler is provided with a body located in a center of the table leveler. This body can have various shapes, such as round, circular, disc, square, rectangular, or other shape. Further, the body includes three, four, or more elongated legs that extend outwardly from the body. Distal ends of the legs attach to an underside of the tabletop along one flat side of the table leveler.

The table leveler includes an arm, lever, latch, or locking mechanism that unlocks the table leveler from the riser. For example, a lever has one end that pivotably or rotatably attaches to the body of the table leveler. A second end moves between two of the legs from a locked position to an unlocked position. In the locked position, the table leveler locks the tabletop so that the tilt or angle of the tabletop is not movable. In the unlocked position, the table leveler unlocks from the riser while staying attached to the bottom of the top of the table. In the unlocked position, the tabletop is moveable in order to adjust or move the tilt or angle of the tabletop.

An end of the riser or support has a curved shape that complements, matches, or emulates a curved shape of one side of the table leveler. For example, the end of the riser has a convex or concave shape, and the side of the table leveler has concave or convex shape that forms a ball and socket engagement or connection with the riser. In the unlocked position, the table leveler freely moves with respect to the riser so the level or angle of the tabletop can be moved and adjusted.

The table leveler can be manufactured from steel, metal, polymers, plastics, wood, composite materials, recycled materials or fibers (including fiber board), and combinations thereof. For example, the table leveler is made by injection molding, vacuum molding, or another method.

The methods and apparatus in accordance with example embodiments are provided as examples, and examples from one method or apparatus should not be construed to limit examples from another method or apparatus. Further, methods and apparatus discussed within different figures can be added to or exchanged with methods and apparatus in other figures. Further yet, specific numerical data values (such as specific quantities, numbers, categories, etc.) or other specific information should be interpreted as illustrative for discussing example embodiments.

What is claimed is:

1. A table leveler that attaches to an underside of a tabletop of a table to enable a user to change a level of the tabletop, the table leveler, comprising:

a first component that includes a circular body that has a concave cavity on one side and an oppositely disposed side with a flat surface that abuts to the underside of the tabletop, and includes a plurality of legs that are equally spaced apart and extend outwardly from the circular body with each leg including a hole that receives a fastener to fasten the first component to the underside of the tabletop;

a second component that attaches to the table and has a mushroom shape in side view and includes a convex shaped end, a threaded hole in a center of the convex shaped end, and a cylindrical extension that extends outwardly from the convex shaped end; and a third component that has a rectangular shaped handle with one end that includes a cylindrically shaped head with a threaded extension that extends outwardly from the cylindrically shaped head, wherein the threads of the threaded extension of the third component engage the threaded hole of the second component and enable the third component to move between a locked position in which the convex shaped end of the second component frictionally locks against the concave cavity of the first component and an unlocked position in which the convex shaped end of the second component frictionally unlocks against the concave cavity of the first component so the first component can move with respect to the second component and adjust the level of the tabletop of the table.

2. The table leveler of claim 1, wherein the table leveler has spider-shape from a top view and includes four legs that are equally spaced apart from each other.

3. The table leveler of claim 1, wherein the plurality of legs have a bone shaped end.

4. The table leveler of claim 1, wherein each of the plurality of legs has a body with a rectangular shape and a rounded end with at least one hole that receives a fastener to connect the table leveler to the table.

5. The table leveler of claim 1, wherein the first component includes a hole that extends through a center of the first component, the third component engages a top surface of the first component such that the threaded extension extends through the hole in the first component so the threaded extension can engage the threaded hole in the second component.

6. The table leveler of claim 1, wherein the second component has a circular shape from a top view with a size equal to a size of the circular body.

7. The table leveler of claim 1, wherein the circular body of the first component includes an arc shaped channel in which the handle of the third component rotates from a first position at one end of the channel in which the table leveler is in the locked position to a second position at another end of the channel in which the table leveler is in the unlocked position, wherein the tabletop can be moved and leveled when the handle is in the second position but not in the first position.

8. A table leveler that attaches to an underside of a tabletop of a table to enable a user to change a level of the tabletop, the table leveler, comprising:

a first component that attaches to the underside of the tabletop and includes a circular body with a concave cavity on one side of the circular body, at least three legs that extend outwardly from the circular body and that are equally spaced around the circular body, and an arc-shaped channel formed in the circular body;

a second component that has a dome-shaped head and a cylindrical extension that extends outwardly from the dome-shaped head such that the dome-shaped head engages against and rotates in the concave cavity of the first component; and a third component that includes an elongated handle and a threaded extension with a cylindrical shape that extends at a right angle with respect to the handle, wherein the handle of the third component rotates within the arc-shaped channel of the first component and moves the third component from a locked position to an unlocked position, wherein in the locked position the concave cavity of the first component frictionally locks against the dome-shaped head of the second component to prevent movement of the tabletop on the table; and wherein in the unlocked position the concave cavity of the first component frictionally unlocks against the dome-shaped head of the second component to enable movement of the tabletop on the table to adjust the level of the tabletop.

9. The table leveler of claim 8, wherein a centrally located hole extends through the table leveler and each of the first component, the second component, and the third component in a side view of the table leveler.

10. The table leveler of claim 8, wherein the table leveler has a star shape with four legs that extend outwardly from the circular body.

11. The table leveler of claim 8, wherein the first component is positioned between the second component and the third component in an exploded view of the table leveler.

12. The table leveler of claim 8, wherein the threaded extension of the third component extends through a hole in a middle of the first component and engages a threaded hole in a middle of the second component to enable the table leveler to move between the locked position and the unlocked position.

13. The table leveler of claim 8, wherein distal ends of the three legs of the first component each have a bone shape.

14. The table leveler of claim 8, wherein the circular body of the first component and the dome-shaped head of the second component have a circular shape with an equal radius as seen from a top view.

15. A table leveler that attaches to an underside of a tabletop of a table to enable a user to change a level of the tabletop, the table leveler, comprising:

a first component with a flat surface that attaches to the underside of the tabletop and includes a body with a concave cavity on one side of the body, at least three legs that extend outwardly from the body and that are equally spaced around the body, and an arc-shaped channel formed in the body;

a second component that has a convex shaped head with a threaded hole in a middle of the second component as seen from a top view and a cylindrical extension that extends outwardly from the convex shaped head such that the convex shaped head engages against and rotates in the concave cavity of the first component; and a third component that includes a handle and a threaded extension that extends at an angle with respect to the handle, wherein the threads of the threaded extension of the third component engage the threaded hole of the second component and enable the third component to move along the arc-shaped channel between a locked position in which the convex shaped head of the second component frictionally locks against the concave cavity of the first component and an unlocked position in which the convex shaped head of the second component frictionally unlocks against the concave cavity of the first component so the first component can move with respect to the second component and adjust the level of the tabletop of the table.

16. The table leveler of claim 15, wherein the threaded extension of the third component extends at a right angle with respect to the handle.

17. The table leveler of claim 15, wherein the table leveler has a T-shape in a side view when the first component, the second component, and the third component are assembled together.

18. The table leveler of claim 15, wherein the first component, the second component, and the third component are manufactured as separate components such that the table leveler can be disassembled into three separate components of the first component, the second component, and the third component.

19. The table leveler of claim 15, wherein the second component has a mushroom shape in a side view, and the first component has four equally spaced legs that extend outwardly from the body that has a circular shape in a top view.

* * * * *